US005136283A

United States Patent [19]

Nobs

[11] Patent Number: 5,136,283

[45] Date of Patent: Aug. 4, 1992

[54] APPARATUS FOR TIMING RACES

[75] Inventor: Erwin Nobs, Evilard, Switzerland

[73] Assignee: Omega Electronics S.A., Bienne, Switzerland

[21] Appl. No.: 538,003

[22] Filed: Jun. 14, 1990

[30] Foreign Application Priority Data

Jun. 15, 1989 [FR] France ..... 89 08087

[51] Int. Cl.[5] ..... G09G 1/02

[52] U.S. Cl. ..... 340/799; 358/213.26

[58] Field of Search ..... 340/799, 753; 358/213.31, 213.19, 213.24, 213.27, 212, 109, 213.26; 360/33.1, 37.1; 354/109; 346/107 B, 107 A

[56] References Cited

U.S. PATENT DOCUMENTS

| | | | |
|---|---|---|---|
| 3,678,189 | 7/1972 | Oswald | 346/107 B |
| 4,133,009 | 1/1979 | Kittler | 360/9 |
| 4,523,204 | 6/1985 | Bovay | 354/109 |
| 4,743,971 | 5/1988 | Hugli | 358/213.26 |
| 4,797,751 | 1/1989 | Yamaguchi | 358/335 |
| 4,875,105 | 10/1989 | Ohashi | 358/14 |

FOREIGN PATENT DOCUMENTS

| | | |
|---|---|---|
| 0002870 | 7/1979 | European Pat. Off. . |
| 2535539 | 2/1976 | Fed. Rep. of Germany . |

OTHER PUBLICATIONS

La Suisse Horlogere et Revue Internationale de l'Horlogerie vol. 83, No. 3, Sep. 1968, pp. 51-56.

Fernseh und Kino Technik vol. 38, No. 2, FEB. 1984, Berlin de pp. 53-57.

*Primary Examiner*—Ulysses Weldon
*Assistant Examiner*—Xiao Min Wu
*Attorney, Agent, or Firm*—Griffin Branigan & Butler

[57] ABSTRACT

This race timing apparatus of the video finish type includes a photo sensitive CCD bar (5) which may be read at a predetermined frequency in correspondence with the run past speed (Vi) of the image of the race. The images are stored and visualized by means of a commercial recorder (22) and monitor (23) of a fixed standardized sweep frequency. Since the image acquisition frequency by the bar is not synchronous with the visualization frequency, one proceeds with the generation of image parts using buffer memories (19, 20), the image parts being next stored in an image memory (21) and then read in a discontinuous manner by jumping over image parts in synchronism with a standard TV sweep. The apparatus enables the offering of a system at a low overall cost price since it employs a recorder and a monitor currently obtainable on the market.

5 Claims, 6 Drawing Sheets

APPARATUS FOR TIMING RACES

FIELD OF THE INVENTION

This invention concerns an apparatus for timing races including an optical arrangement installed at a fixed station and in the extension of a crossing line of a race comprising several competitors, in order to project an image of such line onto a photo sensitive bar which includes a plurality of pixels juxtaposed in a single column.

BACKGROUND OF THE INVENTION

The patent document CH-A 590 518 has already described a system for the determination of times separating the passages of moving objects to the right of a reference line substantially perpendicular to the trajectory. This system consists of employing a television camera equipped with a cathode ray tube, which camera is directed onto the reference line, recording the signals provided by said camera and simultaneously signals provided by a timekeeper and reproducing the signals with the aid of a monitor. In order to accomplish this, one employs a camera by means of which one effects a unidirectional linear scan coinciding with the reference line and a reader effecting a linear bidirectional scan in a manner such that the successive scans of the reference line by the camera are spread out over the screen of the reader in a direction perpendicular to that in which the unidirectional scans are effected, thus in the direction of the trajectory of the moving objects. The document mentions that this camera may be of a conventional type, where however the two scans are permuted in a manner such that the more rapid scan is effected in a vertical direction and a slower scan has been suppressed. As a variant it is said that one will employ preferably a diode camera of the type referred to as solid state in the place of a cathode ray tube in order to avoid marking the tube or indeed the rapid deterioration of the latter.

This system is illustrated on FIGS. 1 and 2 of the present description. The moving object 2 is displaced at a speed $V_m$ in front of lens 1 of the camera. Behind the lens is found a unidimensional photosensitive arrangement 5 using a solid state detector, here further called a CCD bar. The image of the moving object runs past at the speed Vi in front of arrangement 5. FIG. 2 shows how this arrangement is formed which includes a row of elementary pixels 6 arranged side by side. The incident light coming from the reference line to be captured produces charges on each of the detectors, which charges represent the intensity profile of a line of the image at a given instant. These charges are periodically transferred in the sense of arrows 9 into a shift register 7 bearing as many elements 8 as there are pixels 6. A clock signal 12 at TV frequency empties the contents of the line towards amplifier 10 in the form of a video signal 11. These video signals are next memorized, then visualized in a manner to represent, in the form of an image, the development in time of the line under observation (finish line for instance).

Several unidirectional arrangements are presently available on the market. They are all equipped with a substantial number of pixels ( >1000) to assure high resolution. For further details on this subject, reference may be had to the technical publications of the manufacturers, for instance to the publication concerning the arrangement GH 7801 A of Thomson-CSF. Complete cameras may even be obtained from the Fairchild Company under the reference CCD 1100C to 1500C or again from the i2S Company (Bordeaux, France) under the denomination iDC 133.

In the system which has just been described, it has been seen that the incident light produces charges on the row of detectors 6 which charges are periodically transferred towards the output 10 via a shift register 7. Here the transfer frequency is fixed since it is tied to an ordinary television standard. In effect, in the cited document is noted a frequency of the images which is 25 units per second, each half image lasting 20 milliseconds. From this fact the system described has the merit of employing standard material as far as concerns the camera as well as the monitor and the recorder. It is thus inexpensive.

The system described unfortunately presents at least two major disadvantages which determine that it has never been employed in practice and remains at the stage of a prototype.

The first difficulty concerns the time of exposure of the pixels which is very small. Effectively, according to the European standard, a half image is explored in 20 ms (50 Hz) and each half image includes 312.5 lines. It follows that the duration of a line is equal to 20/312.5 0.064 ms = 64 μs and that the scan frequency is 1/64 μs, i.e. 15,625 lines per second. Thus, in employing a unidimensional photosensitive arrangement with standard TV sweep, each pixel will be excited only during 64 μs per scan. This represents an extremely short time which limits the domain of application of the arrangement to scenes presenting substantial lighting, since for average illumination the signal gathered will not emerge at all or very little from the background noise, at least with the means presently available.

The second difficulty concerns the deformation of the images collected. It will be understood in effect that to obtain a non-deformed image, it will be necessary that the speed of refreshing of the photo sensitive arrangement given by the clock signal 12 (see FIGS. 1 and 2) correspond to the speed Vi of the image running past on said arrangement. The image collected will be compressed if the speed Vi is greater than the refreshing speed or on the contrary, will be dilated if the speed Vi is less than said refreshing speed. An example drawn from practical situations will facilitate understanding of the problem which is posed.

The CCD bar as mentioned hereinabove includes a multiplicity of pixels of a substantially squared off surface, the side of which measures substantially 13 μm. With the standard TV at 625 lines, these 13 μm are scanned as already been said in 64 μs, which corresponds to the image of a moving object which would be displaced at the speed Vi of:

$$\frac{13 \cdot 10^{-3}\ \text{mm}}{64 \cdot 10^{-6}\ \text{s}} = 203\ \text{mm/s}.$$

In this case, the scan frequency is adapted to the speed of the race and the images reproduced appear without deformation. Now this value corresponds to the speed Vi of an automobile race running in front of the CCD bar. Should one now wish, with the same apparatus, to capture the images of an athletics race of which the speed of the image Vi may be estimated to be 26 mm/s, the image collected will be strongly dilated in width deforming the shapes of the athletes to the point of rendering them unrecognizable. If one wanted thus to obtain an image without deformation of the athletics race, it would be necessary to lower the scan frequency of the bar which correspondingly will increase the time during which the pixels of the bar are exposed. In taking the speed of 26 mm/s and a pixel of 13 μm on one side, one may calculate the exposure time, then the scan frequency to be applied to the bar. The exposure time is:

$$\frac{13\ \mu m}{26\ mm/s} = 500\ \mu s.$$

and the scan frequency is 1/500 μs=2,000 lines per second. To take another example, the exposure time and the scan frequency would be respectively of 3.25 ms and 307 lines per second if one considered a boating trial where the speed of the image Vi running in front of the bar is on the order of 4 mm/s.

It follows from what has just been said that in order to obtain a non-deformed image of the course to be timed, it is indispensable to adapt the scan frequency of the bar to the speed of the image running past onto such bar in the same manner as one adapts the speed of film in a system employing a film running past behind a slot (process of photo-finish described in the patent document CH-A-399 028). In the arrangement set forth in patent document CH-A 590 581 cited hereinabove, this adaptation is effected only for high speed races such as for automotive vehicles. It will be understood that in order to capture the image of an athletics race, not only must the scan frequency of the bar be reduced to the values indicated hereinabove, but further it is necessary to have available a reader (monitor, video recorder) the scan frequency of which is tuned and synchronous with that which explores the bar. This will never be the case if one wishes to employ a commercial reader conceived for a single frequency (15,625 lines per second) and established once and for all. In order to resolve this problem, it has been proposed to employ a reader having an adaptable frequency. One could also propose that the processing and storing of images be effected in a PC. Whatever be the chosen solution, it will be necessary to employ a complex and onerous collection of apparatus.

The patent document EP-A-O 223 119 proposes however an apparatus for capturing the image of sporting races including a pulse generator for controlling the transfer of charges from one sensor to the other, in a manner such that the speed of this transfer is made to correspond to the speed of the image of the race which is passing in front of the arrangement. No detail however is given concerning the manner in which the image is reconstructed the text being satisfied to explain that this reconstitution is brought about according to techniques known in television, the line frequency being synchronized with the charge transfer frequency, which implies a monitor and a video recorder which are non-standard.

The patent document EP-A-0 207 675 likewise proposes a video recording apparatus for sporting races including a one dimensional sensor in the form of a bar. The signal gathered at the output of the sensor is converted by an A/D converter into a series of image elements which are stored in a video memory in order to form a plurality of images arranged end to end. This system is however limited to the capacity of the memory, typically to 16 TV images as the description indicates. Such is due to the fact that in this system there are not two buffer memories alternately working, one in reading and the other in writing as is the case in the invention which will be described hereinafter.

The patent document US-A-4 133 009 proposes for its part two buffer memories working alternately. However, the capacity of these memories is determined by an entire TV image from whence there does not result difficulty in reconstituting the TV image in a standard monitor and video recorder. This system cannot be applied to capturing the image of races along with a time scale for one arrives at ambiguities in passing from one image to the other (overlapping) since at no moment is there to be found on the screen the juxtaposition of a plurality of image portions at the same time, so as to bring about a temporal continuity between one of the portions and the portions which precede and follow said portion, as is proposed by the present invention.

If this invention employs several of the characteristics as described in the three documents which have just been discussed, it is with an entirely different purpose from that pursued by said documents. The problem to be solved here results from the fact that as the frequency of image acquisition by the bar is not synchronized with the frequency of visualization, one proceeds with generating portions of an image employing buffer memories, such image portions being next stored in an image memory, then read in a discontinuous fashion by jumping over portions of the image in synchronism with a standard TV sweep. Thanks to this arrangement, the images are recorded and visualized by means of a standard commercial recorder and monitor at a scan frequency which is fixed and standardized.

SUMMARY OF THE INVENTION

Thus, the principal purpose of this invention is to offer an apparatus for timing races equipped with a one-dimensional CCD bar which is adapted to several speeds of races without deforming the image and while employing a simple image sensor, operating to the ordinary television standard which is currently obtainable on the market. Thus with this system the monitor and the video recorder are inexpensive and contribute accordingly to reduce the price of the overall apparatus assembly.

To obtain this result, the apparatus of the invention is notable in that it includes:

means for reading the contents of the bar at a predetermined frequency chosen as a function of the speed of the race, said contents showing up in the form of an electrical signal corresponding to the intensity profile of the line image at a given instant;

first and second buffer memories alternately adapted to memorize a predetermined number of electrical signals resulting from successive readings of the bar in order to form respectively first and second image parts of the race;

means for alternately transferring said first and second image parts into an image memory adapted to store n image parts of substantially equal capacity, the apparatus being arranged in a manner such that, when the first buffer memory stores the signals issuing from the bar, the image part contained in the second buffer memory is written into the image memory and vice-versa, said image memory exhibiting at the time of each writing an image part in the course of writing and n−1 image parts already written;

means for reading in accordance with a predetermined order said n−1 parts already written into the image memory in a manner such that the first image part read corresponds to the part freshest in time already written into the image memory and so on in accordance with a chronological order;

a monitor of standard TV type for displaying on a screen the n−1 image parts read in the image memory in a manner such that, at the time of each writing of a new image part into the image memory, the freshest portion appearing on the screen takes the place of the preceding portion, this latter undergoing a jump displacement so as to be placed beside said freshest portion, and a recorder of standard TV type for recording the images appearing on the monitor.

The invention will now be set forth with the aid of the following description illustrated by way of example by the drawings.

DESCRIPTION OF THE PREFERRED EMBODIMENT

Figure 1:
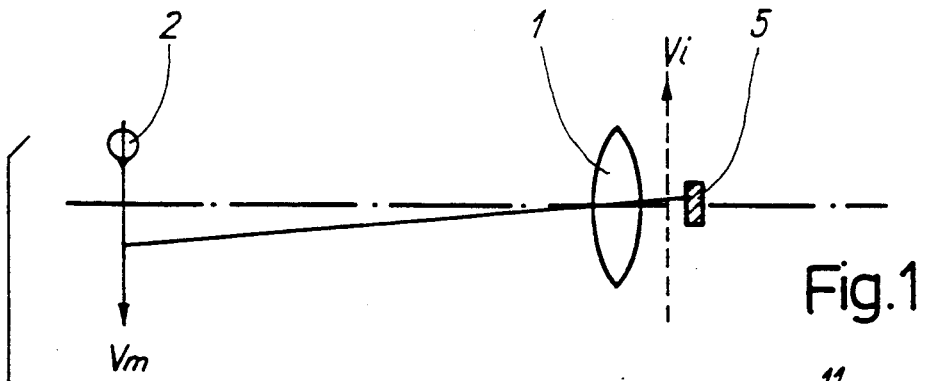
FIGS. 1 and 2 represent the prior art as discussed hereinabove.
Figure 2:
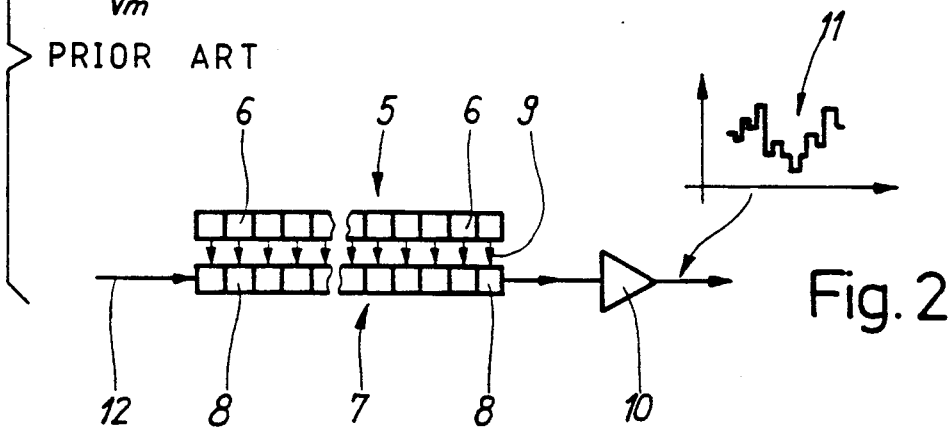
Figure 3:
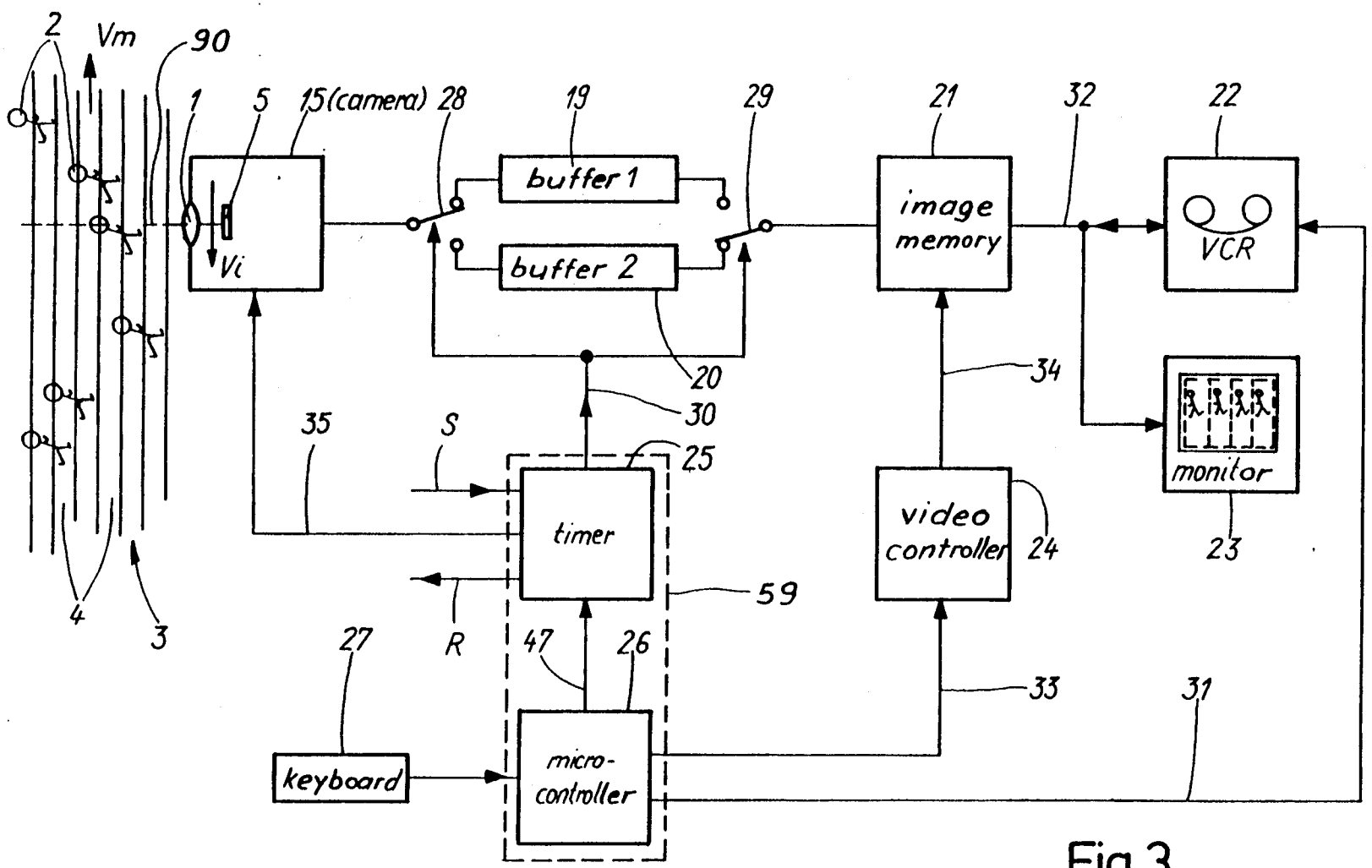
FIG. 3 is a block diagram illustrating the invention according to a simplified embodiment permitting solely the acquisition of images and including essentially two buffer memories and an image memory.

The block schematic of FIG. 3 shows a simplified embodiment of the invention. Here runners 2 each progressing in a corridor 4 at a speed Vm cross in turn a passage line 90 which may be the finish line of the race. In the prolongation of this passage line is located an optical arrangement or lens 1 forming part of a camera 15. The image of the line 90 is formed on a photo sensitive bar 5 which is located behind the lens 1. In a plane perpendicular to FIG. 3, bar 5 is as illustrated on FIG. 2 and is comprised of a plurality of pixels juxtaposed in a single column. The image of the runner runs past at speed Vi in front of the bar. A time base or timer 25 coupled to the camera by connection 35 enables reading the contents of the bar at a predetermined frequency, each reading being followed by a refreshing of the bar. The reading frequency is chosen to correspond to the speed Vi of the image of the race. It is understood thus that at any given instant the contents of the bar existing in the form of an electrical signal is found to be equal to the intensity profile of the image of line 90.

The reading frequency of the bar is chosen by the operator of the apparatus as a function of the speed of the race for which he must retain the images. For this the operator has available a keyboard 27 on which he may introduce manually the value of such speed. A microcontroller 26 serves as an interface between keyboard 27 and the time base 25, which permits to derive from the time base —generally furnishing the time of day—the reading frequency chosen by the operator. Likewise from the keyboard the operator may signal the person responsible for giving the starting signal of the race that the apparatus is ready to receive images of the race. This signal issues from the time base 25 via the line R (ready). Inversely, the time base 25 of the apparatus may be reset to zero, then started by the starting signal of the race and this by the line S (start). It should be mentioned that the time base 25 and the microcontroller are circuits obtainable in commerce, for instance under the designation Intel 80186 which combines blocks 25 and 26 in a single integrated component.

The electrical signals resulting from the successive readings of the bar 5 are memorized initially in a first buffer memory 19 via a switch 28 set according to the position shown on FIG. 3. In the embodiment taken as example, when 128 columns including 512 pixels have been memorized in buffer 19, timer 25 switches the output of the bar onto the input of a second buffer memory 20 which memorizes in turn 128 new columns captured by the bar. One is thus in the presence of image portions each including 128 columns. In the example of a sweep of 2,000 columns per second, each portion of the image thus represents a race time of 128/2,000=64 ms.

FIG. 3 shows that the contents of buffer memories 19 and 20 may be alternately led via another switch 29 to an image memory or video RAM 21. This switch is controlled by timer 25. It is seen that when the buffer memory 19 stores the electrical signals coming from bar 5, the content of buffer memory 20 is transferred into the image memory 21 and vice-versa. For this it is understood that switches 28 and 29 are operated in synchronism and controlled by timer 25. It will here be noted that the buffer memories are capable of storing 128 columns, each comprising 512 distinct signals. These may be memories of the type Hitachi HM 62536.

The image memory 21 has a capacity sufficient to memorize n portions of the image coming from the buffer memories 19 and 20. When the apparatus operates and at each instant of its operation, it will be understood that the memory image presents one portion of image in the course of being transferred or writing in and n−1 portions of image already transferred or already written. Such a memory may be of the type Intel 514256. By means of a video controller 24—which may be of the type Intel 82786—one next reads according to a predetermined order the n−1 portions of the image already written into the video RAM 21 in a manner such that the first portion of the image read corresponds to the freshest temporal portion written into said video RAM and so on according to chronological order. Next the images read according to the order indicated hereinabove are displayed on a monitor 23 of ordinary TV standard and parallelly registered in a recorder 22 of ordinary TV standard in a manner such that after each writing of a new image portion into the image memory 21 the freshest portion displayed on the screen of the monitor 23 takes the place of the portion previously displayed, this latter undergoing a displacement by jump in order to be placed beside the freshest portion.

Should one wish for a time increase extending from left to right on the screen, it will be arranged so that the freshest portion of the image appearing on the screen is found to the right of such screen, the display of a new portion of the image displacing the portion of the image which was previously found there toward the left. There it concerns an image reconstruction from several partial images, each of said partial images including in the embodiment taken as an example 128 columns. How the operation of the synchronization with an ordinary TV standard is brought about will be explained hereinafter when a more complete embodiment of the invention is discussed.

Figure 4:
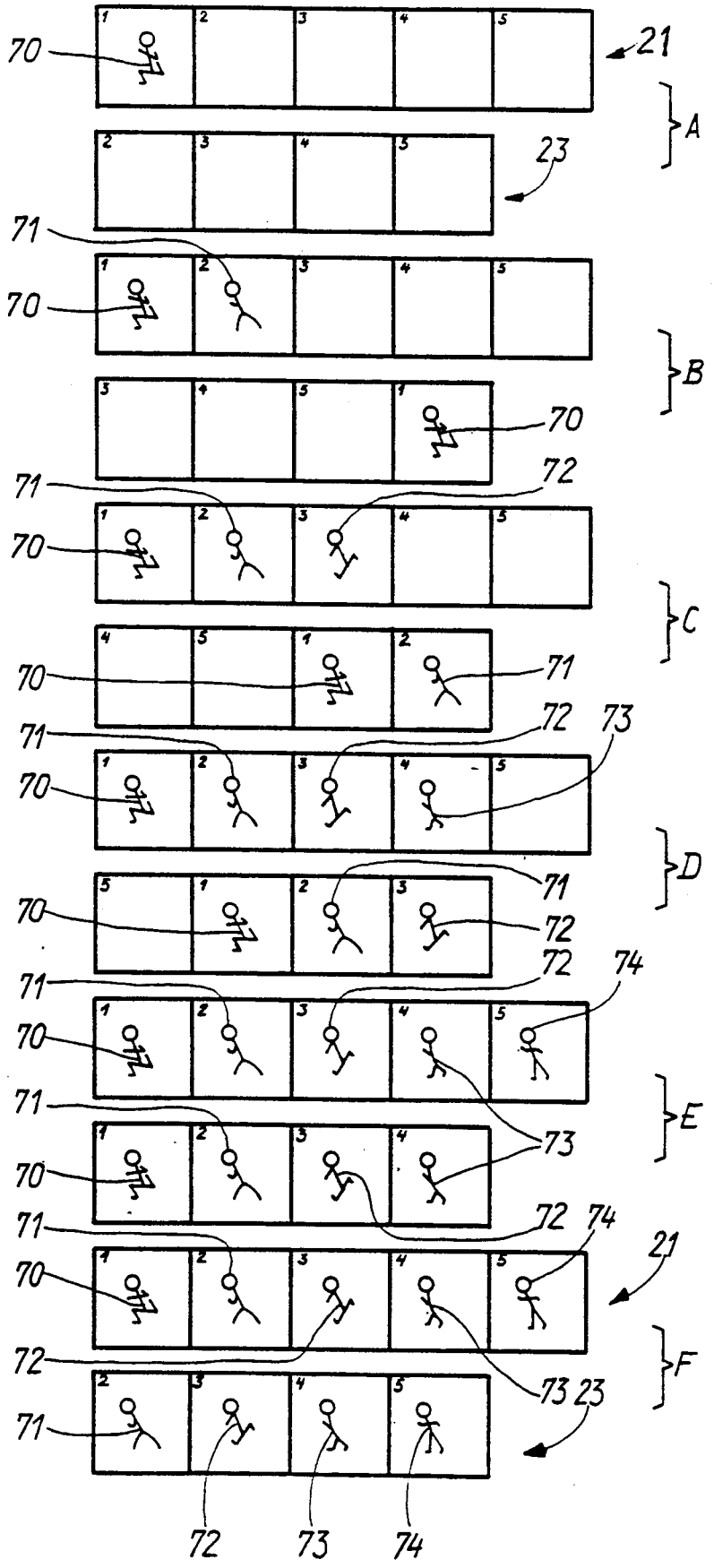
FIG. 4 is a graphical illustration of how from portions of the image stored in an image memory one constructs a complete image visible on a monitor.

FIG. 4 will facilitate understanding of the reconstruction mechanism of the image as mentioned hereinabove. Reference 21 designates the image memory and reference 23 the monitor screen. The image memory may contain five portions of the image represented by five compartments numbered 1 to 5. There is initially the transfer of the contents of the buffer memory 20 (see FIG. 3) into the image memory 21. The runner 70 is then written into compartment 1. Following this transfer, one reads compartments 2 to 5 of the image memory and one displays them on the monitor. In the example, compartments 2 to 5 of the memory being empty of information, the monitor will not display any information (FIG. 4*a*). When the buffer memory 19 is entirely filled by the image portion acquired from bar 5, switches 28 and 29 change position and the content of buffer 1 is transferred into compartment 2 of the image memory: the runner 71 is written into compartment 2. Following this writing in one reads in order 3, 4, 5 and 1, the compartments of the image memory. The runner 70 appears to the right of the monitor screen 23 (FIG. 4B). During the following stage shown on FIG. 4C, there is a new acquisition in the compartment 3 of the image memory, which acquisition is determined by runner 72. Following this acquisition, one reads again the compartments already written from the image memory in a manner such that the first image portion read corresponds to the portion which in time is the freshest already written into the memory. Here it concerns runner 71 followed by runner 70 and the two empty compartments 5 and 4. There then appears on the monitor screen from right to left the runners 71 and 70, the runner 70 being displaced towards the left in order to leave its place to the new arrival 71. During the following stage (FIG. 4D), it is runner 71 which is transferred into the image memory 21 bringing about the display on the monitor screen 23 of runners 72, 71 and 70. The process continues thus as shown on FIGS. 4E and 4F. It is to be noted on FIG. 4F that the transfer of the new runner 74 into the image memory has chased from the screen the first runner 70 which no longer appears thereon. In the example shown here, one sees that the image memory may contain five image portions ($n=5$) and that the monitor screen displays four of these portions ($n-1=4$). It will be noted that the invention is not limited to this arrangement and that n may be different from 5.

What precedes has explained the general principle of the invention, to wit how one constructs a complete image from image portions which are displaced by jumps as their acquisition progresses. Here it concerns however a much simplified version of the invention which does not enable appreciation of the rank of the runners. As in most cases, in addition to the necessity of separating the runners according to the rank which they occupy, it is indispensable to determine the time taken by each competitor in order to traverse the space separating the starting line from the line under control; it is necessary to attach to the race image a time scale corresponding to these images.

Figure 5:
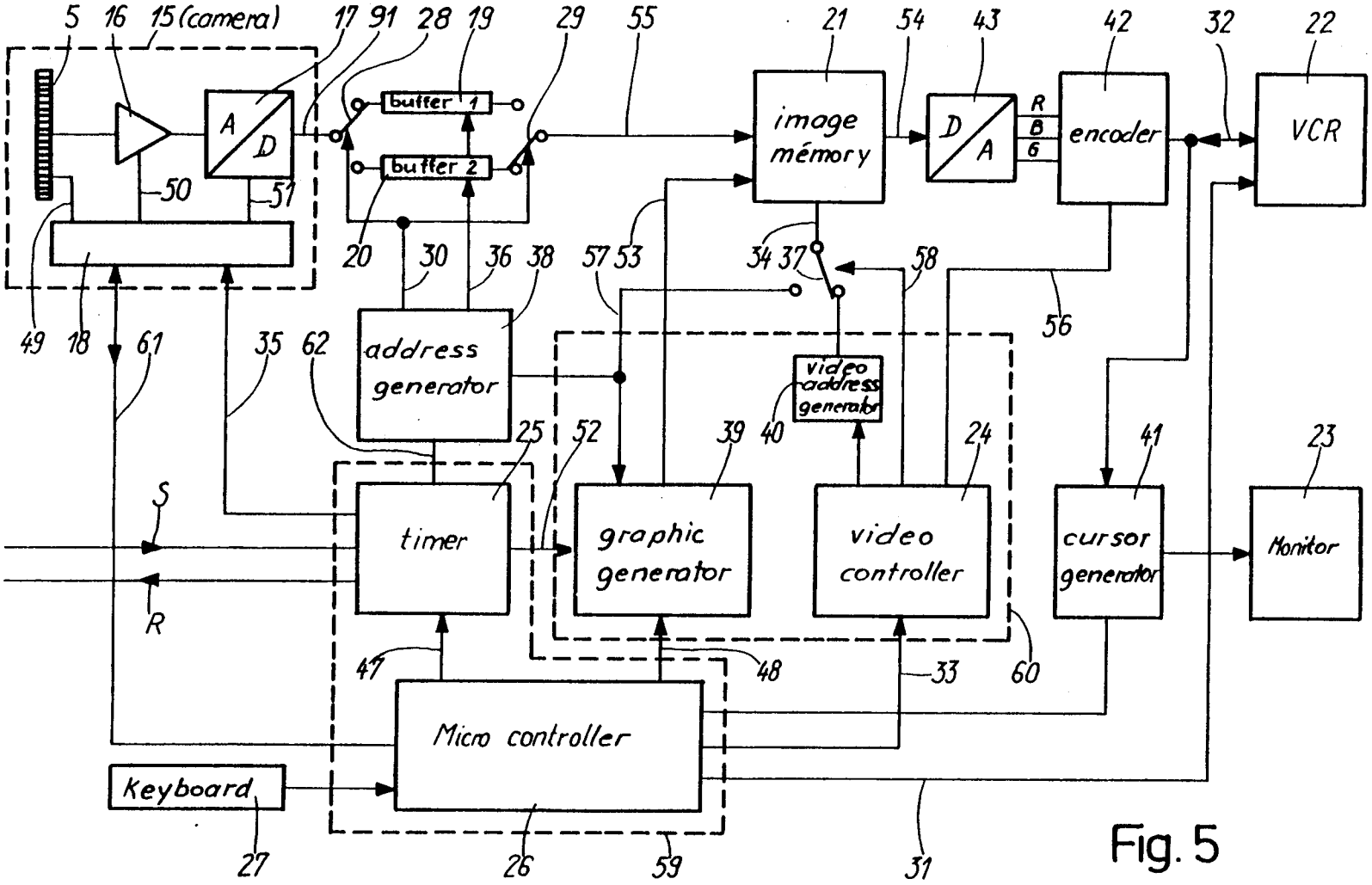
FIG. 5 is a block schematic showing the invention according to a more developed embodiment permitting, in addition to the acquisition of images, the inscription of the time corresponding to the images.

FIG. 5 shows a perfected embodiment of the invention which takes up all the elements discussed in respect of FIG. 3 in adding to them elements enabling the creation of a time scale and other elements bringing certain advantages which will appear upon reading the lines to follow.

Camera 15 summarily schematized on FIG. 5 includes a bar 5 of at least 512 pixels arranged in a column. The signals coming from the bar are amplified by an amplifier 16 of which the gain may be varied, for example as an automatic function of the lighting of the objective to be sensed. A first converter 17 transforms the analog signals coming from amplifier 16 into digital signals, each pixel being represented by 8 bits (=1 byte). The first six bits encompass information relative to 64 grey levels of pixel, the last two being employed for instance for transmitting information relative to the colour of the pixel. The camera is controlled by a controller 18 from whence are issued for instance the scan frequency of the bar (line 49), the gain control of the amplifier (line 50) and the converter control (line 51). Controller 18 receives signals from the time base 25 (line 35) and is coupled to the microcontroller 26 by a bidirectional line 61. It has been mentioned hereinabove that this camera may be bought already complete from the company i2S (Bordeaux, France). The signals coming from camera 15 by line 91 are led to switch 28 in order to alternately feed the buffer memories 19 and 20 as has already been explained hereinabove. In the same manner, from the moment that a buffer is filled, its contents are written into the image memory 21 via switch 29 and line 55. The signals gathered at the output of the image memory are led via line 54 to a second converter 43 which converts the digital signal coming from the image memory into an analog signal which, via lines R, G, B is led to an encoder intended to link the system to readers (monitor and video recorder) of a standard type according to the ordinary standard colour TV. It will be mentioned that one may employ for the second converter 43 the Booktree BT 478 circuit and for the coder the Motorola MC 1377 circuit following the PAL or NTSC standard. A Philips circuit TDA 2506 would enable adaptation to the SECAM standard. The other elements (buffers, image memory, timer, microcontroller) are of the same type as those already mentioned hereinabove.

The schematic of FIG. 5 is to be noted in the sense that it enables creation of a graphic time scale with digital references enabling easy reading of the race time. The graphic generator is represented at 39. It forms, together with the video controller 24 already mentioned in connection with FIG. 3 and a video address generator 40, a unique component 60 which is of the type Intel 82786 already identified.

Figure 6:
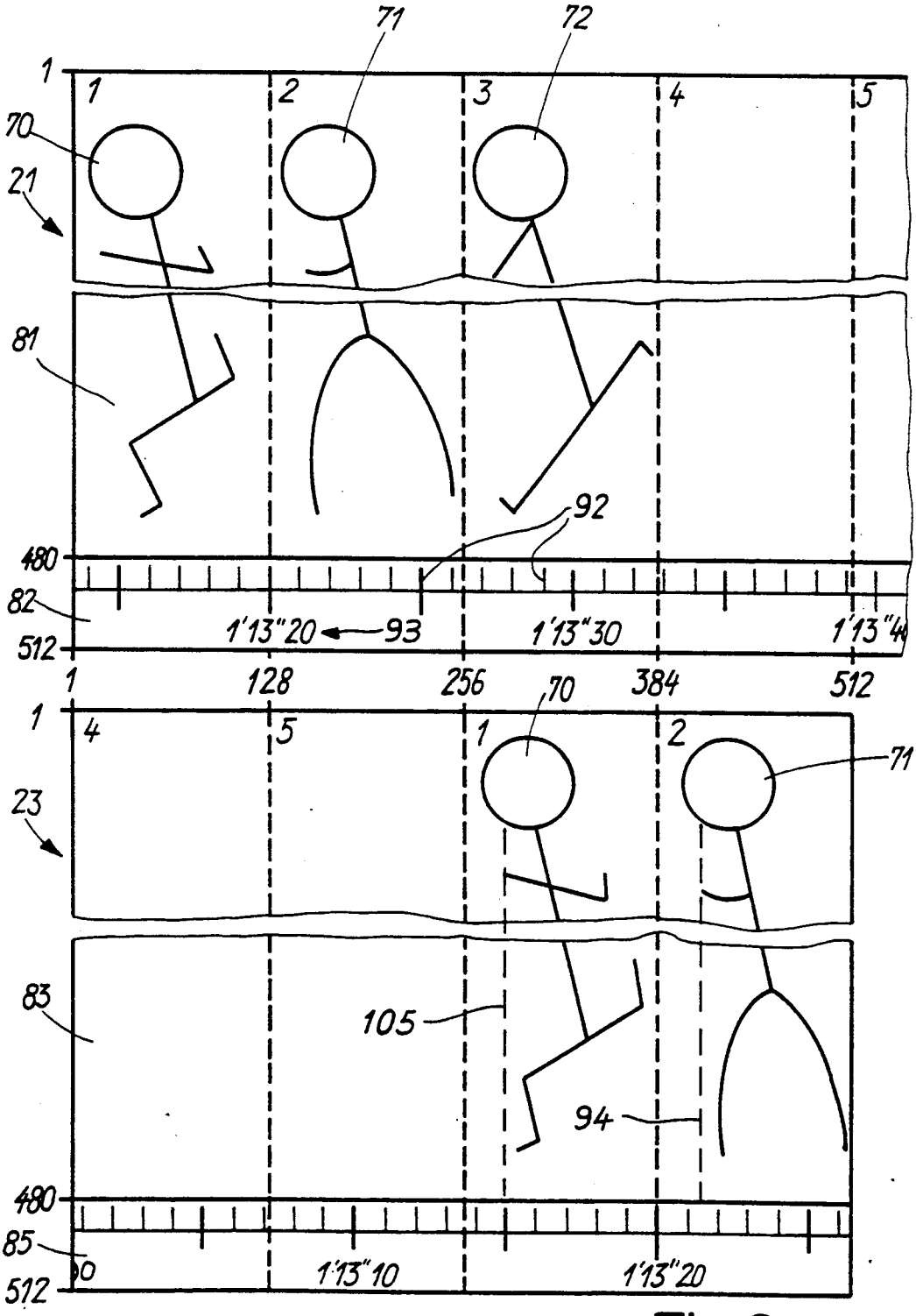
FIG. 6 is a graph showing partially the graph of FIG. 4 to which a time scale has been added.

The construction of the image is brought about in the same manner as that discussed with reference to FIGS. 3 and 4 with a time scale in addition. FIG. 6 shows a special situation taken at the same moment as that represented on FIG. 4c. The image memory 21 includes a zone image 81 comprising runners 70, 71 and 72. This zone includes five portions, each composed of 128 columns, each column itself comprising 480 bytes. The image memory 21 includes further a time scale zone 82 comprising time subdivisions 92 and a writing arrangement 93 labelled in minutes, seconds and tenths of a second (for example 1'13"20). This zone likewise includes five portions, each composed of 128 columns, each column including 32 bytes. In FIG. 6, the runner 72 is in the course of being written into the image memory and the runners 71 and 70 have already been written into said memory. It follows that there appear on screen 23 runners 71 and 70, the runner 71, the most recently acquired, appearing at the right of the screen. If one traces straight lines 105 and 94, which moreover are applied to form a cursor which will be discussed subsequently to the vertical of the position of the runners, one will find that the runner 70 has crossed the space separating the starting line from the line under control in a time equal to 1'13"15, while runner 71 has traversed the same space in a time equal to 1'13"213, the runner 70 preceding thus by 6.3 hundredths of a second runner 71.

Figure 7:
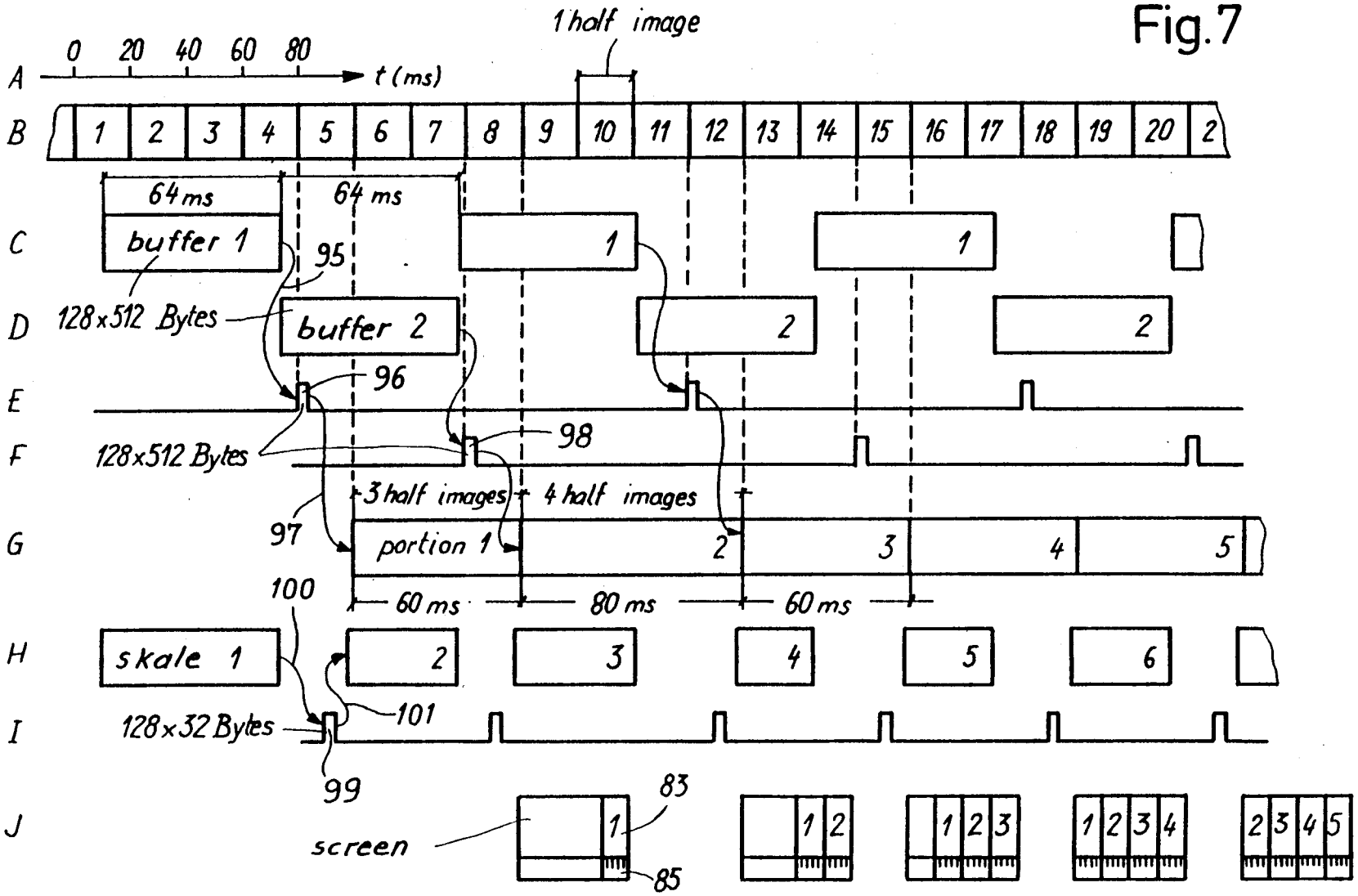

FIG. 7 is a timing diagram which will facilitate understanding of the arrangement of the schematic of FIG. 5. Line A of FIG. 7 indicates the time scale, 20 milliseconds separating two divisions. Line B indicates in the ordinary standard TV 625 lines and, referenced by 1, 2, 3 etc., the succession of half images each being of 20 ms. The readers (monitor 23 and recorder 22) respond to this standard in the example chosen here. From the camera 15 one acquires the images at a rate that one chooses at 2,000 columns per second, which corresponds to the athletics race mentioned hereinabove. The time for filling a buffer memory 19 or 20 will thus last 128/2,000=64 ms, which is shown on lines C and D of the diagram of FIG. 7. When buffer 1 is in acquisition, switches 28 and 29 occupy the position drawn on FIG. 5 and buffer 2 is in the situation of being able to transfer its contents to the image memory. When buffer 1 is filled, the timer 25, via an address generator the role of which will be explained further on, causes switches 28 and 29 to reverse roles via line 30. Buffer 1 may then be transferred into the image memory (arrow 95). This transfer is shown by line E of the graph of FIG. 7. The figure shows that the transfer does not take place immediately, but only in synchronization with the beginning of the scan of the half image following immediately the end of the filling of buffer 1, as it happens the beginning of the half-image 5 of the line B. At the end of this operation the 128×512 bytes of the buffer 1 are present in the image memory and the transfer time will have lasted during the time shown at 96 on line E. The portion of the image memorized in the image memory may then be visualized on the monitor screen. This visualization commences from the beginning of the scan of a half-image following immediately the end of the transfer into the image memory (arrow 97), as it happens at the beginning of the half-image 6 (line B) and stops at the end of the half-image 8 from which it is the buffer 2 transferred by 98 into the image memory which is visualized on the screen according to the same process as that explained hereinabove with reference to buffer 1. It will next be noted that the portions 1, 2, 3 etc. visualized on the screen (line G) are then completely synchronized with ordinary standard TV images. The figure shows that portions 1, 3, 4 and 5 last 60 ms and portion 2 lasts 80 ms. If one were to continue the graph, one would find new portions at 80 ms, for instance that which would be the portion 7 of line G. One thus finds the portions of the visualization of which the duration of immobilization on the screen covers three, respectively four half-images, which corresponds to at least one complete TV image in the first case and two complete images in the second case.

One will add to this that this transfer of the image portion contained in the buffer towards the video RAM 21 will be effected during the TV lines which are not used, i.e. in the example and for one image during 625−512 =113 lines. This transfer must be synchronized with the image frequency or interlace frequency and one will have available to bring this about at most three half-images. The graph of FIG. 7 shows a transfer brought about once, but one will understand that it could be effected three times. Such being the case, the transfer time available is 113·64 μs·3/2=10,848 μs, if 64 μs is the duration of a line in 625 line TV. This time will permit calculating the transfer time of one byte which is of 10,848 (128·512) 0.165 μs, which time is entirely compatible with the memories presently available on the market.

FIG. 7 further shows in line H the creation of the time scale. While buffer 1 is loaded in images acquired from the bar, graphic generator 39 of FIG. 5, coupled to timer 25 by line 52, generates a scale of times synchronized with the columns acquired from the bar. At the beginning of the acquisition of an image portion, the race time or time of day is read on a chronometric counter. Knowing the time of origin of a portion and the time increment for each column of such portion, the graphic generator has available sufficient information to trace the time scale for the 128 columns of one portion. To accomplish this work, generator 39 has available at least 64 ms, the duration for filling a buffer memory from which duration it is necessary to subtract the transfer time of the graphic data in the video RAM. The pixels thus generated are temporarily deposited in a graphic RAM memory of 128×32 pixels forming an integral part of the graphic generator 39. This information is next transferred to the image memory 21 by line 53 at the end of the image data coming from one of the two buffers 19 or 20. The diagram of FIG. 7 shows that the transfer 96 of an image portion is followed by transfer 99 (line I) from scale 1 into the image memory (arrow 100). As soon as this transfer has taken place, the graphic generator is again available for the creation of the following scale, as it happens, scale 2 (arrow 101). Finally, the first portion of the image to appear on the screen is complete with the image of the race in the upper zone 83 and the time corresponding to the image of the race in the lower zone 85 as shown by line J of FIG. 7.

FIG. 5 further shows a switch 37 controlled by the video controller 24 over line 58. It will be understood that when the image memory 21 is in the read mode (transfer of data towards the visualization screen), switch 37 is positioned as shown on the figure, while when such memory is in the write mode, the switch couples lines 34 and 57 of the schematic.

Graphic generator 39 may furnish information other than that relative to the time. It is thus that in the writing zone there could appear for each image portion an order number indicating in an increasing manner the order in which these portions are acquired, which would permit facilitating the locating thereof. The graphic zone could also bear a text identifying the race with which one is concerned.

Figure 8:
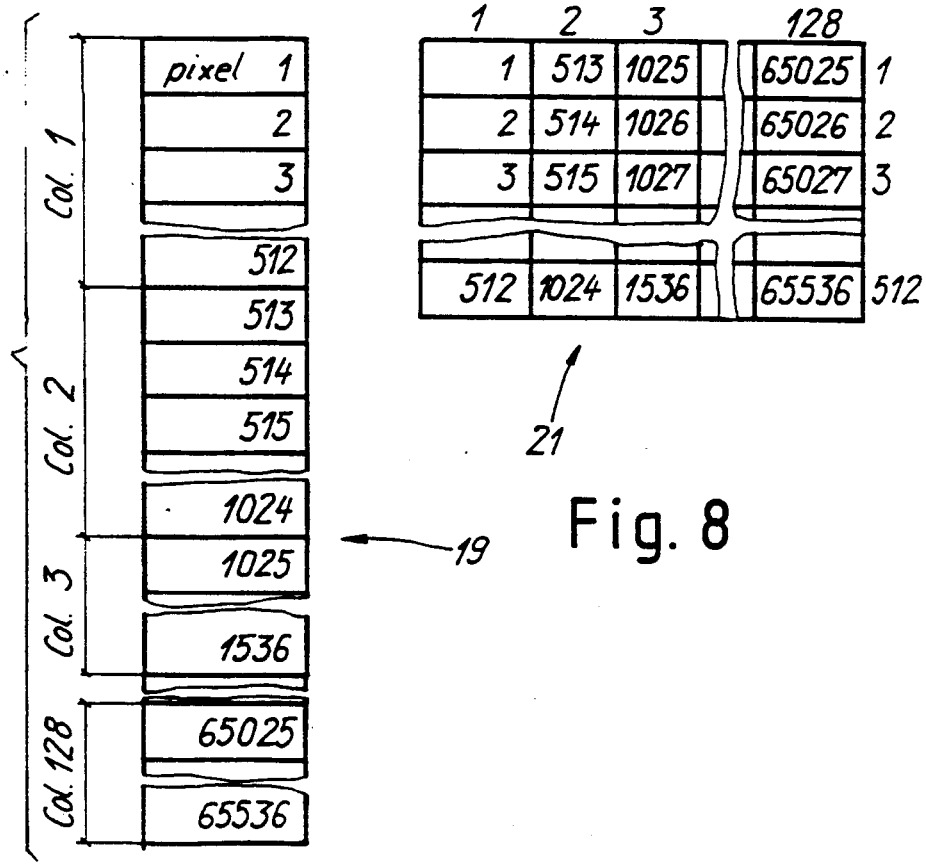
FIG. 7 is a timing diagram applicable to the block schematic of FIG. 5 showing the progress of image acquisition and FIG. 8 shows how the buffer memories and the image memory are organized as well as the manner in which the signals of said buffer memories are transferred to said image memory.

In addition to what is shown on FIG. 3, FIG. 5 further shows an address generator 38 which acts directly on buffers 19 and 20 by line 36. The buffer memory used here stores the pixels, the ones behind the others, as is seen by reference 19 on FIG. 8. Pixel 1 of column 1 is followed by 128×512 pixels to end up at pixel 65536 of column 128. It follows that this type of memory is not organized to be read according to a horizontal scan associated with the ordinary standard TV. It is the role of the address generator to proceed to transfer the pixels into the image memory according to an order compatible with such ordinary TV standard. FIG. 8 shows at 21 a portion of memory 21 organized in a suitable manner.

The schematic of FIG. 5 shows a video recorder 22. It is seen that image generation proceeds in a discontinuous fashion by jumps of 128 columns. This is in fact not troublesome since the images are sent to the video recorder 22, then exploited in a deferred manner in the image by image mode. Furthermore, apart from the utilization in image by image, other functions associated with such a recorder may find a utilization of interest, in particular the digitalization of the image, the zoom image in image and the research for the good image sequence, etc.

Keyboard 27 of FIG. 5 enables several important functions such as:

- initialization of the system, date, time of day, graphic representation mode, colours, etc.;
- introduction and memorization of several titles;
- introduction of parameters, for example acquisition speed;
- gain, camera diaphragm;
- priming the start for the chronometric counter;
- beginning and end of acquisition;
- specific orders to the VCR such as positioning of the tape, search for the proper sequence image by image, stop on an image, recording, reading, etc., this as a function of the VCR possibilities;
- control of the cursor on the screen. The latter is shown only in read mode;
- preparation of titles.

The cursor just mentioned hereinabove is created by a cursor generator 41 which appears on FIG. 5. This generator is adapted to generate a vertical bar of small thickness on the image displayed by the monitor and traversing the image from top to bottom. This bar may be horizontally displaced so as to attribute a time to a chosen point of the image. This cursor generator may be obtained simply by means of a ramp generator and a voltage reference to be compared therewith. The cursor width will be chosen to be on the order of two pixels.

The examples given hereinabove are based on a European standard of 625 lines. It will be understood that the invention may be applied by analogy to other standards, for instance to the American standard of 525 lines.

What I claim is:

1. An apparatus for timing races including an optical arrangement installed at a fixed station and in the extension of a crossing line of a race comprising several competitors in order to project an image of such line onto a photo sensitive bar which includes a plurality of pixels juxtaposed in a single column, said column of pixels storing signals corresponding to an intensity profile of an image of the line at a given instant, such apparatus comprising:

means for reading said column of pixels at a predetermined frequency chosen as a function of anticipated speed of the race, to produce an electrical signal corresponding to an intensity profile of the line image at a given instant;

first and second buffer memories alternately adapted to memorize a plurality of said electrical signals resulting from successive readings of the column of pixels in order to form respectively first and second image parts of the race;

means for alternately transferring said first and second image parts into an image memory adapted to store n image parts of substantially equal capacity, n being equal to or greater than 3, the apparatus being arranged in a manner such that, when the first buffer memory stores the signals issuing from the bar, the image part contained in the second buffer memory is written into the image memory and vice-versa, said image memory exhibiting at the time of each writing an image part in the course of writing and n−1 image parts already written;

means for reading and for setting in a shape suitable for a standard type TV monitor in accordance with a predetermined order said n−1 parts already written into the image memory in a manner such that the first image part read corresponds to the part freshest in time already written into the image memory and so on in accordance with a chronological order;

a monitor of standard TV type for displaying on a screen the n−1 image parts read in the image memory in a manner such that, at the time of each writing of a new image part into the image memory, the freshest portion appearing on the screen takes the place of the preceding portion, this latter undergoing a jump displacement so as to be placed inside said freshest portion, and a recorder of standard TV type for recording the images appearing on the monitor.

2. An apparatus as set forth in claim 1 including a first converter located between the bar and said first and second buffer memories for converting the electrical signal coming from said bar into a digital signal and a second converter located between the image memory and the monitor for converting the digital signal coming from the image memory into an analog signal.

3. An apparatus as set forth in claim 1 including a time base and means for resetting to zero and starting up said time base, a graphic generator controlled by said time base and adapted to generate a time scale synchronized with said predetermined frequency, and means for graphically storing in the image memory said time scale at the same time as said image parts in order to separate the competitors participating in the race.

4. An apparatus as set forth in claim 3 including a generator adapted to generate a vertical bar of small width on the image displayed by the monitor traversing said image and capable of being horizontally displaced so as to attribute a time to a chosen point on the image.

5. An apparatus as set forth in claim 1 including an address generator acting on the buffer memory the contents of which is transferred into the image memory so as to organize the positioning of said electrical signals in said image memory in a manner such that they can be read in order by a horizontal sweep conforming to that of a standard TV.

* * * * *